US008550175B2

(12) United States Patent
Shafiq et al.

(10) Patent No.: US 8,550,175 B2
(45) Date of Patent: Oct. 8, 2013

(54) WELL COMPLETION WITH HYDRAULIC AND ELECTRICAL WET CONNECT SYSTEM

(75) Inventors: Muhammad Shafiq, Al-Khobar (SA); Donald W. Ross, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 375 days.

(21) Appl. No.: 12/635,106

(22) Filed: Dec. 10, 2009

(65) Prior Publication Data

US 2011/0139458 A1 Jun. 16, 2011

(51) Int. Cl.
*E21B 43/00* (2006.01)
*E21B 17/02* (2006.01)

(52) U.S. Cl.
USPC ..... 166/386; 166/65.1; 166/68; 166/242.6

(58) Field of Classification Search
USPC ..... 166/313, 50, 373, 386, 387, 65.1, 166/68, 69, 105, 242.6
See application file for complete search history.

(56) References Cited

U.S. PATENT DOCUMENTS

| | | | | |
|---|---|---|---|---|
| 4,246,978 | A | 1/1981 | Schulz | |
| 4,767,349 | A * | 8/1988 | Pottier et al. | 439/191 |
| 6,257,332 | B1 * | 7/2001 | Vidrine et al. | 166/250.15 |
| 6,257,338 | B1 * | 7/2001 | Kilgore | 166/387 |
| 6,415,869 | B1 * | 7/2002 | Smith | 166/381 |
| 6,533,039 | B2 | 3/2003 | Rivas | |
| 6,547,011 | B2 * | 4/2003 | Kilgore | 166/387 |
| 6,705,403 | B2 | 3/2004 | Podio | |
| 6,881,079 | B2 | 4/2005 | McHugh | |
| 6,983,796 | B2 | 1/2006 | Bayne | |
| 7,104,324 | B2 * | 9/2006 | Wetzel et al. | 166/278 |
| 7,398,822 | B2 | 7/2008 | Meijer | |
| 7,510,003 | B2 | 3/2009 | Meijer | |
| 7,533,461 | B2 * | 5/2009 | Griffiths | 29/869 |
| 7,640,977 | B2 * | 1/2010 | Jonas | 166/242.6 |
| 7,644,755 | B2 * | 1/2010 | Stoesz et al. | 166/65.1 |
| 7,735,555 | B2 * | 6/2010 | Patel et al. | 166/278 |
| 7,814,969 | B2 * | 10/2010 | Shaw | 166/65.1 |
| 7,900,705 | B2 * | 3/2011 | Patel | 166/319 |
| 7,950,454 | B2 * | 5/2011 | Patel et al. | 166/278 |
| 8,082,983 | B2 * | 12/2011 | Patel et al. | 166/205 |
| 2001/0018977 | A1 * | 9/2001 | Kilgore | 166/387 |
| 2002/0050361 | A1 * | 5/2002 | Shaw et al. | 166/380 |
| 2002/0125009 | A1 * | 9/2002 | Wetzel et al. | 166/278 |
| 2003/0211768 | A1 * | 11/2003 | Cameron et al. | 439/191 |
| 2005/0045329 | A1 * | 3/2005 | Wetzel et al. | 166/278 |
| 2005/0072564 | A1 * | 4/2005 | Grigsby et al. | 166/65.1 |
| 2007/0068704 | A1 | 3/2007 | Krueger | |
| 2007/0144746 | A1 * | 6/2007 | Jonas | 166/380 |
| 2007/0227727 | A1 * | 10/2007 | Patel et al. | 166/250.01 |
| 2007/0275585 | A1 * | 11/2007 | Griffiths | 439/275 |
| 2008/0029274 | A1 | 2/2008 | Rytlewski | |

(Continued)

*Primary Examiner* — Jennifer H Gay
(74) *Attorney, Agent, or Firm* — David J. Groesbeck; Brandon S. Clark

(57) ABSTRACT

A technique facilitates deployment of completion stages downhole in a well environment. A first completion stage is deployed downhole into a wellbore with a plurality of control lines having at least one hydraulic control line and at least one electrical control line. A second completion stage is assembled with an electric submersible pumping assembly and a plurality of corresponding control lines having at least one hydraulic control line and a least one electric control line. The second completion stage is conveyed downhole into the wellbore until engaged with the first completion stage which automatically joins the plurality of control lines. The control lines may then be used to operate both electrical and hydraulic devices of the first completion stage.

15 Claims, 3 Drawing Sheets

(56) References Cited

U.S. PATENT DOCUMENTS

| | | | | |
|---|---|---|---|---|
| 2008/0047703 | A1* | 2/2008 | Stoesz et al. | 166/65.1 |
| 2008/0223585 | A1* | 9/2008 | Patel et al. | 166/385 |
| 2009/0008078 | A1* | 1/2009 | Patel | 166/50 |
| 2009/0242212 | A1* | 10/2009 | Shaw | 166/378 |
| 2009/0321069 | A1 | 12/2009 | Jonas | |
| 2010/0206577 | A1* | 8/2010 | Martinez | 166/369 |
| 2011/0139458 | A1* | 6/2011 | Shafiq et al. | 166/313 |
| 2011/0180272 | A1* | 7/2011 | Head | 166/378 |
| 2011/0214883 | A1* | 9/2011 | Patel | 166/378 |

* cited by examiner

WELL COMPLETION WITH HYDRAULIC AND ELECTRICAL WET CONNECT SYSTEM

BACKGROUND

In many well applications, completions are delivered downhole to enable the controlled production of hydrocarbon based fluids. Depending on the environment and the components used in a given completion, the completion system is sometimes delivered downhole in two stages. However, deployment of two or more completion stages can be a difficult and complex procedure, particularly if the initial completion is an intelligent completion.

SUMMARY

In general, the present invention comprises a system and methodology for deploying a plurality of completion stages downhole in a well environment. A first completion stage is deployed downhole into a wellbore with a plurality of control lines having at least one hydraulic control line and at least one electrical control line. A second completion stage is assembled with an electric submersible pumping assembly and a plurality of corresponding control lines having at least one hydraulic control line and a least one electrical control line. The second completion stage is conveyed downhole into the wellbore until engaged with the first completion stage which automatically joins the plurality of control lines. The control lines may then be used to operate both electrical and hydraulic devices of the first completion stage.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for forming connections between stages of a multi-stage completion. In one embodiment, a completion stage, comprising an electric submersible pumping assembly, is joined downhole with a corresponding completion stage having a plurality of devices, including electrically and hydraulically controlled devices. The devices may be part of an intelligent completion system and/or inflow control completion system in which electric and hydraulic systems are used in the same completion.

The use of intelligent completion systems and inflow control device completion systems in combination with an electric submersible pumping assembly in a separate completion stage enables optimized production and enhanced recovery of hydrocarbon fluids. Additionally, permanent downhole monitoring systems may be incorporated into the completion system to monitor downhole pressure and temperature to further enhance production optimization. The electric submersible pumping assembly facilitates the production of hydrocarbon fluid, e.g. oil, from wells that are incapable of producing naturally at commercially viable rates. The electric submersible pumping assembly artificially lifts oil to the surface in wells characterized by low reservoir pressure, high water cut, and/or high back pressure from surface facilities.

Figure 1:
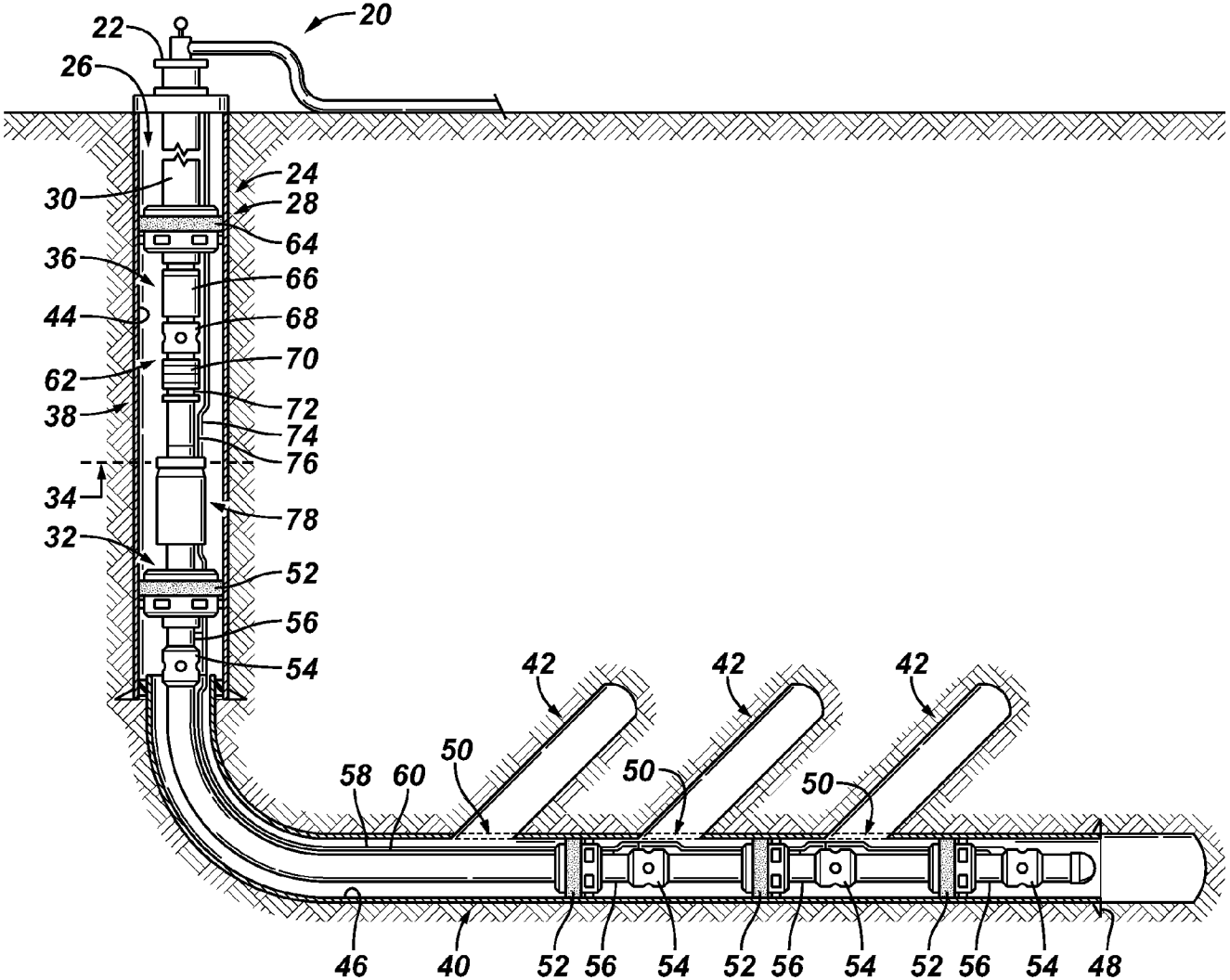
FIG. 1 is a front view of a multi-stage completion system deployed in a wellbore, according to an embodiment of the present invention.

Referring generally to FIG. 1, one example of a generic well system 20 is illustrated as comprising a wellhead assembly 22, e.g. a Christmas tree assembly, positioned over a well 24 having a wellbore 26. A completion 28 is deployed into wellbore 26 via a conveyance 30 which may be in the form of tubing, such as production tubing or coiled tubing. The completion 28 is delivered downhole in a plurality of completion stages. For example, a first or lower completion stage 32 is initially delivered downhole as a tubing string and is represented generally below dashed line 34. Subsequently, a second or upper completion stage 36 is delivered downhole as a tubing string for engagement with first completion stage 32. The second completion stage 36 is generally above dashed line 34.

In the embodiment illustrated, well 24 is a multilateral well having a generally vertical wellbore section 38, a main lateral wellbore section 40, and additional lateral wellbore sections 42 which direct flow of hydrocarbon fluids to the main lateral wellbore 40. In this example, both vertical wellbore section 38 and lateral wellbore section 40 are cased with casings 44, 46, respectfully. However, completion 28 may be employed in a variety of wells, including cased wells, open hole wells, partially cased wells, vertical wells, inclined wells, horizontal wells, multi-zone wells, and various types of single or multilateral wells.

Depending on the specific well application, the first completion stage 32 and the second completion stage 36 may be constructed with various arrangements of components. In the example illustrated, first completion stage 32 is an intelligent completion stage with inflow control. The first completion stage 32 is deployed within casing 46 which terminates at a liner shoe 48. Casing 46 comprises a plurality of openings 50 through which well fluid flows from lateral wellbore sections 42 into main lateral wellbore 40 from a plurality of wells zones. The first completion stage 32 may comprise a plurality of multi-port packers 52 which separate the inflows of well fluid from the different well zones.

First completion stage 32 also may comprise a plurality of other flow control devices, including a plurality of flow control valves 54, separated by packers 52, and a plurality of monitoring systems 56. The monitoring systems 56 also may be separated by packers 52 to enable monitoring of the fluid inflow from each well zone. The various devices, e.g. flow control valves 54 and monitoring systems 56, are connected via a combination of control lines including one or more hydraulic control lines 58 and one or more electrical control lines 60. By way of example, the flow control valves 54 may be controlled by the one or more hydraulic control lines 58, and the monitoring systems may be coupled to the one or more electrical control lines 60 to receive and/or convey data on monitored production parameters, e.g. temperature and pressure. In some applications, the multi-port packers 52 also may be controlled via inputs from one or more of the control lines 58, 60. Additional and/or alternate powered devices and data providing devices may be incorporated into the first completion stage 32 and coupled with control lines 58, 60.

Similarly, the second completion stage 36 may comprise a variety of components selected according to the specific environment and production application. In the example illustrated, second completion stage 36 comprises an electric submersible pumping assembly 62 located below a packer 64, such as a multi-port packer. The electric submersible pumping assembly 62 may comprise a variety of components, such as a submersible pump 66 connected to a pump intake 68. A submersible motor 70 of the electric submersible pump assembly 62 powers the submersible pump 66 and may have multiple sensors 72. The second completion stage 36 also may comprise portions of one or more hydraulic control lines 74 and one or more electrical control lines 76 which correspond with hydraulic control lines 58 and electrical control lines 60, respectively, of first completion stage 32. The control lines 74, 76 serve as hydraulic and electrical supply lines for supplying hydraulic fluid and electricity to the flow control related devices of first completion stage 32.

Figure 2:
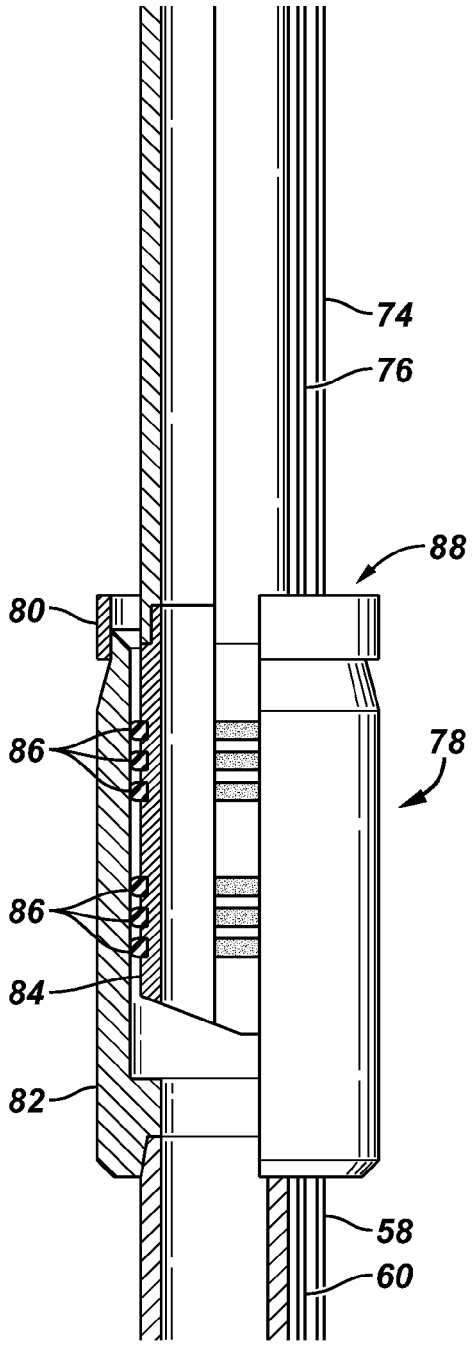
FIG. 2 is a front view of a wet connect system for connecting hydraulic and electrical control lines during the engagement of completion stages, according to an embodiment of the present invention.

The multi-stage completion 28 also comprises a wet connect system 78, which is illustrated in enlarged form in FIG. 2. The wet connect system 78 comprises a tubing string connector 80 for connecting the tubing strings of first completion stage 32 and second completion stage 36. By way of example, tubing string connector 80 may comprise a receiver 82, such as a polished bore receptacle, for receiving a corresponding insert 84 which may comprise a plurality of seals 86 to ensure sealing engagement between the tubing string of second completion stage 36 and the tubing string of first completion stage 32. In the embodiment illustrated, receiver 82 forms part of first completion stage 32, and insert 84 forms part of second completion stage 36. It should be noted, however, that the receiver 82 and insert 84 may be reversed, or tubing string connector 80 may be designed with other types of components capable of forming a sealed connection.

Wet connect system 78 further comprises a control line connector portion 88 designed to automatically connect hydraulic control line segment 74 with hydraulic control line segment 58 of the first completion stage 32. Similarly, the control line connector portion 88 automatically connects the electrical control line segment 76 with electric control line segment 60 of the first completion stage 32. As insert 84 is moved into receiver 82 to connect the tubing strings, the hydraulic control lines and electrical control lines also are simultaneously and automatically connected. Depending on the application, individual or multiple hydraulic lines and individual or multiple electrical lines may be simultaneously connected.

By way of example, the hydraulic control line 74 and electrical control line 76 extending along second completion stage 36 may have terminations 90, 92, respectively. Additionally, the hydraulic control line 58 and electrical control line 60 of first completion stage 32 may have corresponding terminations 94, 96, respectively. In one example, terminations 90, 92 are male terminations and terminations 94, 96 are female terminations sized to sealingly receive terminations 90, 92. A plurality of seals 98 may be mounted on male terminations 90, 92 to ensure a secure, sealed engagement of the control lines. As the second completion stage 36 is moved downhole into engagement with the first completion stage 32, wet connect system 78 causes the automatic coupling of both hydraulic control lines and electrical control lines to enable operation of the flow control related devices, e.g. flow control valves 54 and monitoring systems 56. In other embodiments, the male and female terminations may be reversed, or other types of wet connect components may be employed to form the hydraulic and electrical wet connections in control line connector portion 88.

Figure 3:
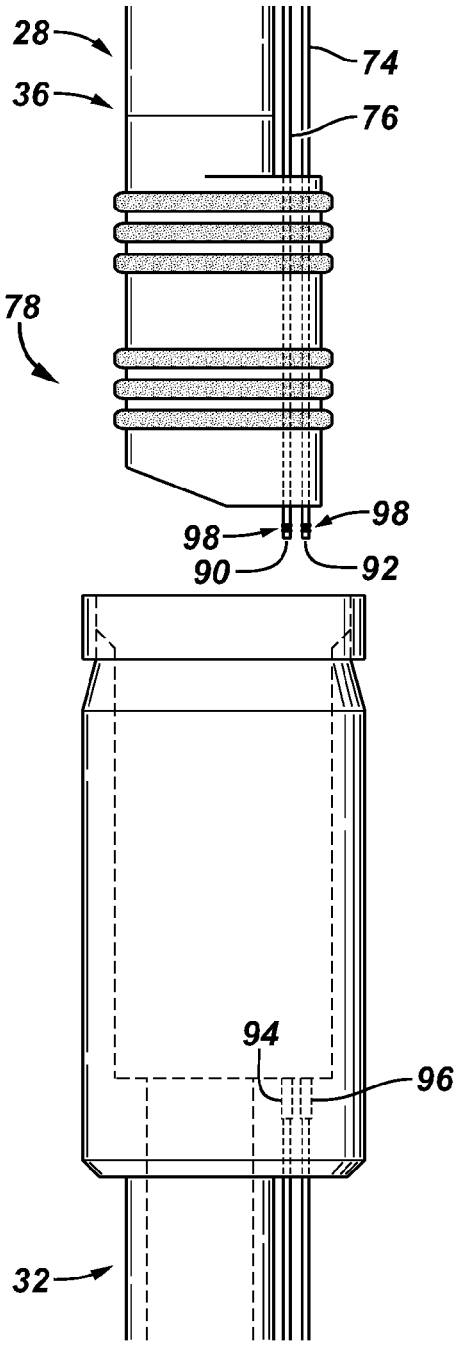
FIG. 3 is a schematic illustration of engagement features of the wet connect system, according to an embodiment of the present invention.
Figure 4:
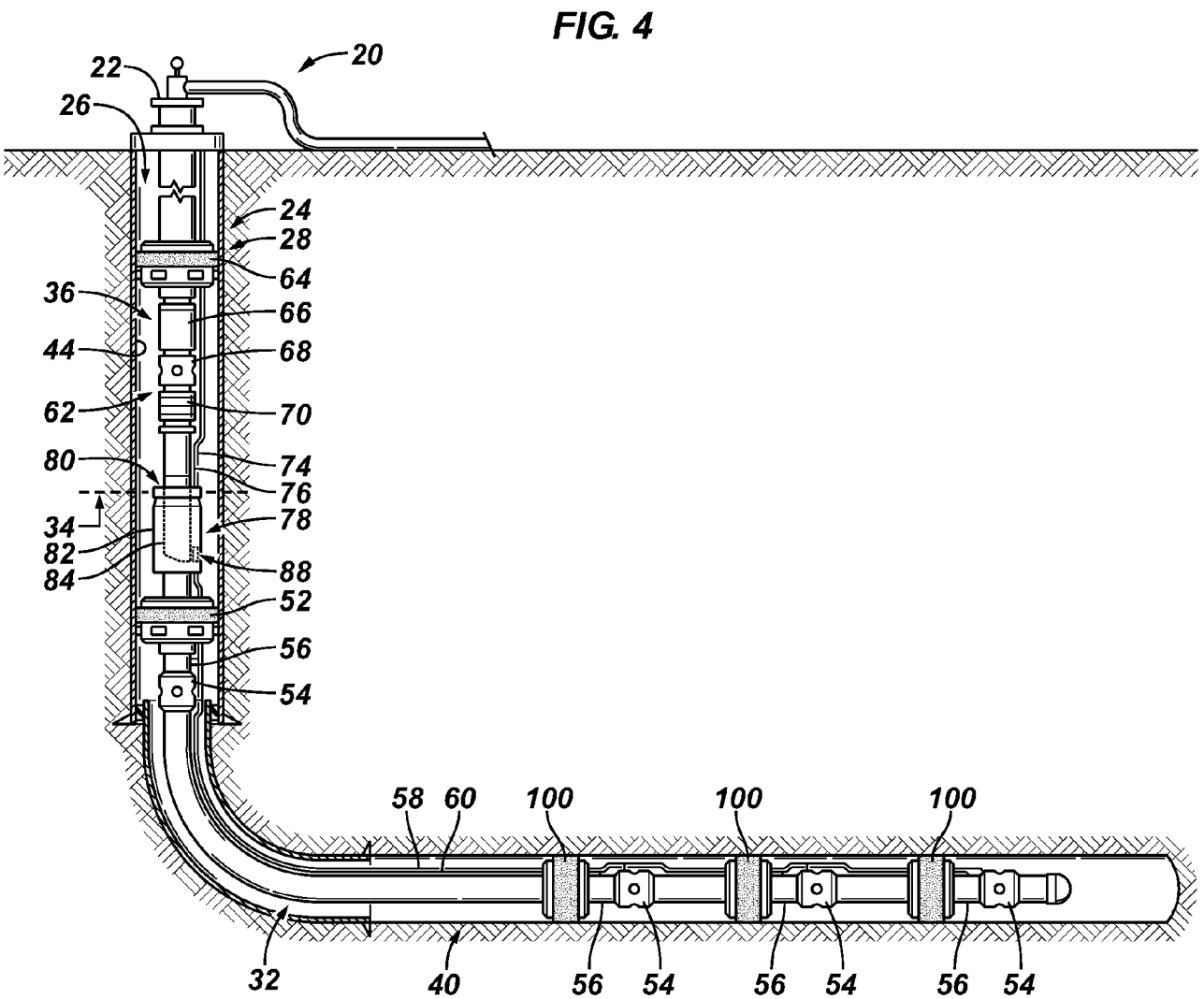
FIG. 4 is a front view of another embodiment of the multi-stage completion system deployed in a wellbore, according to an alternate embodiment of the present invention.

One embodiment of an electrical and hydraulic wet connect system is illustrated in FIGS. 1-3 as enabling combination of an electric submersible pumping assembly and intelligent completion from separate completion stages. However, the wet connect system 78 may be used to combine hydraulic and electrical control lines in a variety of completion systems in which an electric submersible pumping assembly is located in one stage of a dual stage completion. As illustrated in FIG. 4, for example, the first completion stage 32 is deployed in an uncased lateral wellbore 40. Consequently, the first completion stage 32 combines the upper multi-port packer 52 (located in the cased, vertical wellbore section 38) with a plurality of open hole packers 100 positioned in the open hole lateral wellbore 40. The open hole packers 100 are used to separate the flow control devices, such as flow control valves 54 and monitoring systems 56.

Accordingly, well system 20 may be constructed in a variety of configurations for use with many types of wells in many types of environments. The configuration of the lower completion and the upper completion may be adjusted according to the environment and specific well application. The electric submersible pumping assembly may incorporate alternate or additional components. Additionally, redundant electric submersible pumping assembly components may be used in some applications to provide greater pumping capacity. The type and arrangement of packers, monitoring systems, flow control valves, and other flow control devices may be changed. Additionally, the electrical and hydraulic control lines may be coupled with a variety of other types of devices that facilitate control over the inflow of production fluids. The wet connect system also may be adapted according to the specific types of hydraulic control lines and/or electrical control lines utilized in a given application. For example, the electrical control line and hydraulic control line may be routed separately or combined in a single cable. Furthermore, various techniques may be used to control first stage devices and/or to obtain data from the first stage devices via the hydraulic/electrical control lines.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for use in a well, comprising:

a multi-stage completion having:

a first stage in the form of an intelligent completion stage, the first stage being deployed in a wellbore and having at least one first stage hydraulic control line coupled to a plurality of flow control valves separated by packers along a plurality of well zones and at least one first stage electrical control line coupled to a plurality of monitoring systems to monitor parameters related to production of a well fluid;

a second stage having an electric submersible pumping assembly, at least one second stage hydraulic control line, and at least one second stage electrical control line; and a wet connect system by which the at least one second stage hydraulic control line and the at least one second stage electrical control line are automatically connected to the at least one first stage hydraulic control line and the at least one first stage electrical control line, respectively, when the second stage is moved downhole into engagement with the first stage, wherein the plurality of flow control valves and the plurality of monitoring systems in the first stage are used in combination with the electric submersible pumping assembly in the second stage based upon the parameters monitored in the first stage to optimize recovery of a fluid from the well by controlling the plurality of flow control valves via fluid flow through the at least one first stage hydraulic control line.

2. The system as recited in claim 1, wherein the packers comprise a plurality of multi-port packers.

3. The system as recited in claim 1, wherein the packers comprise a plurality of open hole packers.

4. The system as recited in claim 1, wherein the second stage comprises a multi-port packer positioned above the electric submersible pumping assembly.

5. The system as recited in claim 1, wherein the electric submersible pumping assembly comprises a submersible pump powered by a submersible motor.

6. The system as recited in claim 1, wherein the first stage extends into a lateral wellbore.

7. A method of completing a well, comprising:

deploying a first completion stage downhole into a wellbore with a first plurality of control lines comprising at least one hydraulic control line and at least one electrical control line;

arranging the first completion stage to monitor production parameters by deploying a plurality of monitoring systems between a plurality of packers positioned along a plurality of well zones;

coupling the at least one electrical control line to the plurality of monitoring systems;

assembling a second completion stage with an electric submersible pumping assembly and a second plurality of control lines comprising at least one hydraulic control line and at least one electrical control line;

conveying the second completion stage downhole into the wellbore until the second completion stage engages the first completion stage and the second plurality of control lines is automatically connected with the first plurality of control hoes at a wet connect system; and using data obtained from monitoring production parameters in the first completion stage in combination with controlling the electric submersible pumping assembly in the second completion stage, based on the data, to optimize production and enhanced recovery of hydrocarbon fluids.

8. The method as recited in claim 7, wherein deploying the first completion stage comprises deploying an intelligent completion stage with a plurality of hydraulic devices and a plurality of electrical devices.

9. The method as recited in claim 7, wherein deploying the first completion stage comprises deploying an intelligent completion stage with a plurality of flow control valves.

10. The method as recited in claim 7, wherein arranging the first completion stage comprises deploying an intelligent completion stage with the plurality of packers in the form of a plurality of multi-port packers.

11. The method as recited in claim 7, wherein arranging the first completion stage comprises deploying an intelligent completion stage with a plurality of hydraulic devices and with the plurality of packers in the form of a plurality of open hole packers.

12. The method as recited in claim 7, wherein deploying comprises deploying the first completion stage at least partially into a lateral wellbore.

13. A system for use in a well, comprising:

a first completion stage comprising a first tubing string having a plurality of flow control valves positioned along a plurality of well zones and separated by packers, the flow control valves being operated via hydraulic fluids supplied through a hydraulic control line, a plurality of electrical devices operated by electricity supplied via an electrical control line, and a monitoring system configured to monitor production parameters in the first completion stage;

a second completion stage comprising a second tubing string having an electric submersible pumping assembly; and a wet connect system by which the hydraulic control line and the electrical control line are automatically coupled with a hydraulic supply line and an electrical supply line when the second tubing string is engaged with the first tubing string, wherein the plurality of flow control valves in the first completion stage is used in combination with the electric submersible pumping assembly in the second stage to optimize recovery of a fluid from the well by controlling the plurality of flow control valves via fluid flow through the hydraulic control line and by operating the electric submersible pumping assembly in the second stage based upon the parameters monitored in the first completion stage.

14. The system as recited in claim 13 wherein the plurality of electrical devices comprises a plurality of monitoring systems.

15. The system as recited in claim 13, wherein the first completion stage is deployed in a cased, lateral wellbore.

* * * * *